United States Patent [19]

Gits

[11] Patent Number: 4,756,413

[45] Date of Patent: Jul. 12, 1988

[54] SHIPPING FRAME

[76] Inventor: Jules C. Gits, 155 Brandon, Glen Ellyn, Ill. 60137

[21] Appl. No.: 915,396

[22] Filed: Oct. 6, 1986

Related U.S. Application Data

[63] Continuation-in-part of Ser. No. 763,943, Aug. 8, 1985, abandoned.

[51] Int. Cl.[4] ..... B65D 85/58

[52] U.S. Cl. ..... 206/318; 206/319; 206/599; 206/600

[58] Field of Search ..... 206/600, 318, 319, 320, 206/597, 599, 454, 525

[56] References Cited

U.S. PATENT DOCUMENTS

| | | | |
|---|---|---|---|
| 2,428,500 | 10/1947 | Nutt | 206/319 |
| 2,575,749 | 11/1951 | Cross | 206/319 |
| 2,928,535 | 3/1960 | Simmons et al. | 206/319 |
| 3,231,084 | 1/1966 | Kean, Sr. | 206/597 |
| 3,315,800 | 4/1967 | Wagner | 206/600 |
| 4,036,361 | 7/1977 | Jacobson et al. | 206/597 |
| 4,412,615 | 11/1983 | Forshee | 206/319 |
| 4,491,076 | 1/1985 | Forshee | 206/600 |
| 4,512,473 | 4/1985 | Thomaswick et al. | 206/597 |

FOREIGN PATENT DOCUMENTS

| | | | |
|---|---|---|---|
| 1076073 | 4/1980 | Canada | 206/600 |
| 2457810 | 1/1981 | France | 206/600 |

*Primary Examiner*—Joseph Man-Fu Moy

*Attorney, Agent, or Firm*—Robert E. Wagner; Lawrence J. Bassuk

[57] ABSTRACT

Large, heavy manufactured goods, assemblies or articles are packaged for storage and transport in a skeletal frame formed of structural foam material such as high density polyethylene. Cross brace and cross brace mounting members extend between peripheral members of the skeletal frame that is otherwise free of interconnecting side wall web material. The cross brace mounting members support the article spaced within the frame while they distribute the weight of the supported article to the peripheral members. Fasteners such as bolts and bands can secure an assembly or article to the cross brace mounting members of a shipping frame. Upper and lower skeleton halves can include integral leg members, or the leg members can be separate parts to be assembled to the skeleton halves. Separate leg members facilitate transporting the shipping frame flat with the skeleton halves nested on one another. The separate leg members can be integrally molded with the lower skeleton half for later removal by cutting interconnecting runners.

43 Claims, 6 Drawing Sheets

SHIPPING FRAME

This is a continuation-in-part-application of a parent application Ser. No. 763,943 filed on Aug. 8, 1985 which now is abandoned.

BACKGROUND OF THE INVENTION

This invention relates generally to packaging arrangements for large, heavy, manufactured goods and particularly relates to packaging arrangements in the form of shipping frames for such goods, the shipping frames being made of structural foam plastic materials that can be re-used and can be covered by a corrugated outer carton.

Previously, corrugated board has been used to package large and heavy manufactured goods such as marine outboard engines and other small gasoline engines such as are used on lawn mowers. For goods such as an outboard engine, sheets of single and multiple thickness corrugated paperboard are cut and folded into many different detail parts. The detail parts are held to one another by gluing and stapling and are fitted to the engine powerhead, stern mounting bracket and lower gear case. The assembled engine and packaging detail parts then are slipped into a sleeve-like plural thickness corrugated board shipping carton that is afterwards sealed at both ends. The sealed cartons can then be placed in a warehouse for storage or can be shipped to a dealer for retail sale.

This form of packaging has exhibited some inadequacies. The cost of forming the detail parts has increased greatly. Large sheets of corrugated board need to be accurately cut, folded and fastened by gluing or stapling to result in the many detail parts and a large or tall finished carton. This requires skill, factory floor space and much hand labor. Next, the goods have to be hand packed with the correct detail parts inserted at the proper locations to insure adequate cushioning and to protect any decorative surfaces and covers. A shortage of one detail part stops the packaging of all the goods, requiring costly investment in sufficient inventory of all such detail parts.

Often the detail parts are improperly assembled to the goods, resulting in the goods falling loose when inside the carton. This requires the carton to be opened, the damaged goods to be repaired or replaced, and the carton to be repacked. The sealed cartons occasionally are carried in the factory to the warehouse or to shipping trucks by side-lift fork trucks. The lift truck squeezes two side-by-side sealed cartons together to lift and move them. Heavy goods such as marine engines require a great squeezing force on the cartons to effect the lifting. Such squeezing force often crushes the internal detail parts, resulting in the cartons slipping from the lift truck and damaging the enclosed goods.

Additionally, the detail parts and shipping carton are often arranged to hold or suspend the enclosed goods vertically to reduce the center of gravity of the carton. This prevents shipping the packed cartons on their sides because of the weakness of the carton in that direction. This limits the number of cartons that can be placed side-by-side in a truck. Further, the large quantity of corrugated packaging materials can add substantial weight to the shipping weight of the goods.

In a warehouse, the corrugated cardboard cartons can absorb moisture that significantly lowers their strength. This has resulted in the lower carton of a stack buckling under the weight of the upper cartons and causing the stack to fall, often damaging the contained goods, and always requiring weakened cartons and internal detail parts to be replaced. This problem of corrugated board weakening due to moisture absorption is pronounced at seaports, where it has been known for side-lift trucks to rip the outer carton off the enclosed goods because the carton and detail parts had greatly weakened due to the high ambient moisture.

A lawn mower manufacturer can have substantial problems with unpacking. Gasoline engines are shipped from their manufacturer to the lawn mower assembly plant in corrugated cartons, often several engines per carton. These mower engines are much lighter than finished marine outboard engines, but still are of significant weight and must be protected from shipping damage by many detail parts that have been hand fabricated and inserted around the engines in the cartons. Unpacking daily shipments of numerous mower engines can require several full-time employees and produces a large quantity of scrap corrugated board refuse. Recycling the scrap corrugated board is possible, but only if it is free of metal banding material often used to close the shipping cartons.

One way to reduce or eliminate the number of detail parts made from corrugated board is by molding styrofoam or urethane foam shells. In other packaging situations, the shells are formed to receive the manufactured goods, such as electronic audio and video equipment, nested in specially shaped cavities between the top and bottom halves. Styrofoam, however, has insufficient strength to carry a heavy outboard marine or lawn mower engine, and urethane foam is too rigid to cushion and absorb the shock that such an engine experiences in shipment.

While many of the problems in packaging and unpacking large, heavy finished manufactured goods are exemplified by the problems associated with marine outboard engines and lawn mower engines, the present invention is believed to apply to many other packing situations faced with like or similar problems.

Inboard marine engines present additional problems due to their heavy weight which typically is 500 to 700 pounds, in packaging for shipping and storing. Previously, the marine engine, which substantially is a four, six or eight cylinder internal combustion engine, is bolted to a skid that has been fabricated from wooden components. A heavy corrugated, doublethickness box then is placed over the engine after wooden vertical supports are fixed therein.

The packaged inboard engines then have been stacked four high in a warehouse and have been shipped two high in a truck for delivery to the distributor and customer. The packaging arragements for these inboard engines present substantially all of the previously described problems including the multiple packaging parts that need to be stocked and assembled and the possible weakness of the packaging materials to support like packages in a multiple package stack. The wooden supports used in all of the described packages vary in strength from board to board making consistently strong packages difficult to attain.

Shipping packages, formed of plastic materials, have been known. For example U.S. Pat. No. 4,284,990 to Kurick discloses a pair of polystyrene shells that engage several automotive glass windshielded therebetween. The curved glass sheets are rigidly bound against a pair of rigid support members extending up from a bottom wall while webbed bottom and top walls and solid peripheral side walls protect the glass sheets from intrusions and damage.

One drawback is that this arrangement of the packaging transmits the weight of the glass directly through the solid support members to the bottom wall requiring the material of the suport members alone to absorb all shock and other forces. Another drawback is that such an arrangement of webbed bottom and top walls and solid peripheral side walls for an inboard or outboard engine would weigh more than the present corrugated board and wood packaging. Some other more resilient and light weight design is desired.

U.S. Pat. No. 4,366,905 to Forshee also discloses a material handling rack, made of Zytel nylon, that can receive and carry small or large parts or units and that is capable of being loaded into transportation vehicles by conventional fork lift trucks. The rack of Forshee comprises four corner posts, two lower side rails and two lower end rails, made of plastic, that are fastened together into a structure forming a bottom rectangle with upstanding posts at the corners. The open areas between the corner posts and rails can be closed with panel members to form an open box. Molded transverse rails can be fastened between the side rails to support machine components such as auto transmissions, but these transverse rails include depending webs to transmit the carried weight downwardly to an underlying floor and not to the side or end rails. This design presents the drawbacks of requiring manual assembly and inventory of the necessary parts and fasteners to assemble same and uses the side and end rails as guards against intrusion and not as primary weight carrying and shock absorbing members.

U.S. Pat. No. 4,491,076 to Forshee discloses a structure having four vertical walls that transmits the weight of the carried components, such as auto transmissions, through the vertical walls to the corner posts, but comprises many molded Zytel nylon parts that must be seprately molded and assembled for use.

A shipping package for large or heavy components that overcomes these undesireable aspects is desired.

SUMMARY OF THE INVENTION

In accordance with the invention, the inadequacies of the prior packaging arrangements are overcome by integrally molding a skeleton shipping frame of structural foam material such as high density polyethylene. The molded skeleton shipping frame then can be engaged around the goods to suspend or support the weight of the manufactured goods and provides a rigid periphery to space the goods from other shipping frames and objects. The high density structral foam skeleton is sufficiently rigid to support heavy goods and also is able to absorb shock that would otherwise damage the goods.

The molded shipping frame of the invention compares in weight and expense with the prior corrugated board packaging arrangements but is more consistent in strength, positively secures the goods to be shipped to one of an upper and lower skeleton half, and eliminates a plurality of detail parts and scrap corrugated board. The shipping frame also eliminates much of the labor previously required to package the manufactured goods and articles. In high volume shipping situations, such as for small gasoline engines, the shipping frames can be reused, further increasing their utility. If desired, an outer dust blocking skin of corrugated board or plastic sheeting can be provided. Where the latter is used, it facilitates visual inspection of the goods in transit without disturbing the shipping frame.

According to one embodiment of the invention, the shipping frame comprises an upper and lower skeleton of integral peripheral members that are molded of structural foam with the skeletons to be joined at their mating ends. With the two halves joined together, the skeleton peripheral members define the outline or periphery of each side of the frame at the margins of the several sides. The area of each side within the outline peripheral members, except for cross-bracing members, is open and free of any wall forming webs of material. Peripheral leg members extending from each skeleton half mate with corresponding peripheral leg members for joining the skeleton halves into a unitary structure.

In another embodiment of the invention, the peripheral leg members are separate, elongate parts that are assembled extending between the upper and lower skeletons and have opposed ends that are configured for a slip fit into slots in the skeleton halves. The leg members and any desired snubbers can be integrally molded with either the upper or lower skeleton on runners extending from the skeleton peripheral members. This insures that the correct number of detail parts, i.e. legs and snubbers, always accompany a skeleton. This further provides for the upper and lower skeletons to be nested with one another and shipped flat to the manufacturer of the large, heavy finished goods, substantially reducing transportation costs. Later, the runners can be cut to release the legs and snubbers and the shipping frame can be assembled to the goods. The legs also can be made of other materials such as wood.

In both embodiments, suitable crossbrace members, integrally molded with the skeletons or skeleton halves, extend between the peripheral members, to receive and carry the manufactured goods to be shipped. Fasteners such as nuts and bolts or straps and bands secure the goods to the cross-brace members. For a marine outboard engine, the engine stern mounting bracket can be fastened with nuts and bolts or clamps to one crossbrace member and another cross-brace member will cradle the engine lower gear case, with bands securing the lower gear case to the crossbrace member. Both of these cross-brace members extend between peripheral members of the lower skeleton half to facilitate mounting of the engine in the frame. The upper skeleton half can have corresponding cross-brace members with snubber extensions against which the outboard engine can nest, for further support. The upper and lower skeleton halves then are secured together with two or three bands to form a unitary shipping frame that can be slipped into an outer carton of corrugated board, completing the packaging arrangement.

The shipping frame provides for items such as an outboard engine to be shipped in any position, retains its strength in high humidity environments and in temperatures in excess of 150° F., has a two-piece construction, is reusable, and can be recycled.

The embodiment with separate leg members can be used to package large, dense goods such as automotive and marine inboard engines. In those cases, the cross-brace members are robust to carry the heavy weight, and openings are provided in the lower skeleton for four-way entry of lift truck fork tines.

In all of the embodiments, the cross brace mounting member or members comprise a mounting portion and support portions spacing the mounting portion inward of the frame and away from the bottom sides of the frame. The cross-brace mounting member is thus supported by the peripheral members of one skeleton half inwardly of the frame. The manufactured article thus is packaged within the frame, spaced from the sides of the shipping frame. This provides some protection from possibly damaging intrusions into the volume of the shipping frame, but more importantly, the support portions distribute the weight of the packaged manufactured article to the peripheral members of the shipping frame so that the weight of the manufactured article is carried in storage and transport by substantially the entire frame, and not just by individual transverse rails or entire wall assemblies. This results in an economy of structural foam material used in the weight and shock absorbing peripheral members, cross brace and cross brace mounting members and a less expensive and lighter weight packaging arrangement for heavy manufactured goods and articles than if solid walls were used.

The peripheral and cross-brace members can be formed in the shape of angles and channels with interior ribs and gussets providing increased strength. The ends of the peripheral leg members can include notched formations for positively interlocking the two skeleton halves together and for interlocking the legs to the upper and lower skeletons.

Other advantages and features of the invention will become apparent upon making reference to the specification, claims, and drawings to follow.

DESCRIPTION OF THE PREFERRED EMBODIMENT

Figures 1, 2:
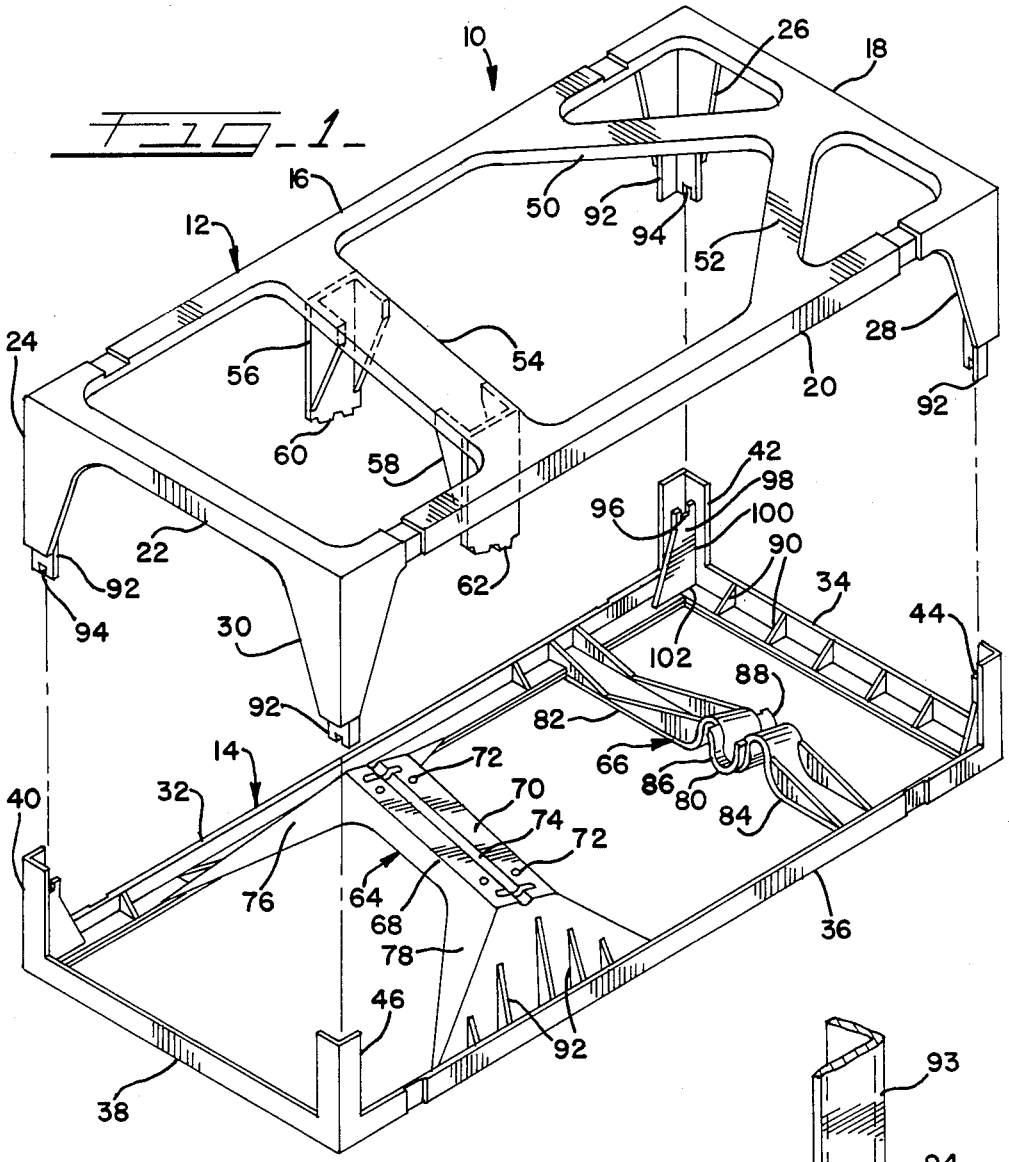
FIG. 1 is an exploded perspective view of one embodiment of the shipping frame of the invention having an upper and a lower skeleton half.
FIG. 2 is a detail view of an interlocking notch structure of the shipping frame.

In FIG. 1, a shipping frame constructed and arranged according to the invention is indicated generally by the reference character 10. Shipping frame 10 presents a box-like exterior frame or weight bearing structure comprising upper and lower skeleton halves 12 and 14.

Upper skeleton 12 has four elongate peripheral top members 16, 18, 20 and 22 joined together at their ends in a rectangle and has four peripheral leg members 24, 26, 28 and 30 depending from the joined ends or corners thereof. Lower skeleton 14, like-wise has four elongate peripheral base members 32, 34, 36 and 38 joined together at their ends in a rectangle and has four peripheral leg members 40, 42, 44 and 46 upstanding from the joined ends or corners thereof. Joining the legs of upper and lower skeletons 12 and 14 forms a structure defining the outline of a six sided rectangular solid.

The bottom surfaces of each of the base members define a base plane that usually will rest on a flat surface such as a warehouse floor for storage or on the bed of a truck for shipment. Of course, when the packages are stacked on one another, the base plane will rest on the top plane surface of an underlying package.

Upper skeleton 12 includes crossbrace member 50 and 52 extending between peripheral members 16, 18 and 20 to rigidify the shipping frame and provide strength against torsional stress. Additional cross-brace member 54 extends between peripheral members 16 and 20 to rigidify same and carry two depending snubber members 56 and 58. Snubber members 56 and 58 terminate at ends 60 and 62 adapted to engage against and help support the manufactured goods to be packaged and shipped in the frame 10.

Lower skeleton 14 includes crossbrace mounting members 64 and 66 extending between the peripheral members 32 and 36. Member 64 is robustly proportioned to carry most of the weight of the marine engine with the stern mounting bracket of the marine engine being bolted or clamped thereto. Mounting member 64 includes a cross channel or mounting portion 68 having a flat mounting surface 70 and bolt holes 72 therethrough. Cross channel or mounting portion 68 also includes a slot 74 across the length of surface 70 able to receive a length of pipe to strengthen the cross channel portion, if desired. Mounting member 64 also includes an opposed pair of support portions 76 and 78 depending downwardly and outwardly from the ends of mounting portion 68 to base member 32 and 36 to support the cross channel or mounting portion 68 above the base plane defined by the peripheral members 32 and 36. Support portions 76 and 78 serve also to transmit the weight of an article carried on mounting portion 68 to the base members 32 and 36 and can compress, extend, flex and twist to absorb shock and other forces encountered in storage and shipping.

The cross-brace mounting member 66 includes a sinuous cradle 80 for receiving the lower gear case of the marine engine. Cradle 80 is held between the peripheral members 32 and 36 by support portions 82 and 84 and includes opposed lower lips 86 and 88, around which bands can be placed to secure the enginer lower gear case to the cradle and shipping frame.

The shipping frame skeleton halves, peripheral members and cross-brace members in the preferred embodiment are formed of a structural foam material, such as high density polyethylene, typically by low pressure injection molding techniques. Of course, other structural foam materials able to provide sufficient strength and resilience to shock can be used. The upper and lower halves preferentially are molded at the same time in separate cavities of the same mold. The leg members thus preferentially have the same height to facilitate molding upper and lower skeleton halves in a mold having a uniform height. The wall thickness of each peripheral and cross-brace member typically is at least one fourth inch. Ribs such as ribs 90 inside the channel of peripheral member 34 and ribs 92 exterior of support portion 78 serve to rigidify the structure and strengthen it for supporting additional weight. Additional ribs and gusset material can be added as desired to strengthen and increase the resilience of the frame.

While other thermoplastic materials can be suitable for this application, high density polyethylene structural foam has sufficient strength to carry the weight of a marine engine and yet has sufficient resilience to absorb shock and other forces occuring during storage and shippng. Further, high density polyethylene structural foam molded in the shape and form of the shipping frame shown weighs substantially less than all of the necessary corrugated board shipping detail parts and carton reducing shipping weight costs. Of course, a molded packaging arragement of two pieces eliminates fabrication and inventory costs and reduces labor time in packaging.

Referring also to FIG. 2, each of the peripheral leg members of the upper and lower skeletons, namely members 24, 26, 28, 30, 40, 42, 44 and 46 include notched structures for registering the members when the skeletons are joined. Each leg member of the upper skeleton includes a right angle extension 93 extending below the lower edge of each member and having a square notch 94 in one plate thereof. Each notch 94 mates or engages with a corresponding notch 96 in a panel 98 upstanding from the lower skeleton below the top edge of the upstanding members.

In the preferred embodiment, the angle extensions 93 are molded to be integral with the leg members 24, 26, 28 and 30. The panels 98 are molded, for example, to have one vertical edge 100, see FIG. 1, integral with its adjacent leg member 42 and to extend similar to a rib therefrom while having a lower edge 102 integral with the peripheral members forming the lower rectangle. With this notch structure, the end of each leg member aligns or registers with and abuts the end of its corresponding leg member on the other skeleton; the end are maintained in registration and kept from sliding off one another by the interlocking of the notches 94 and 96 at each leg member. The extensions 93 are guided to the recessed panels 98 by the leg members of the lower skeleton.

Figure 3:
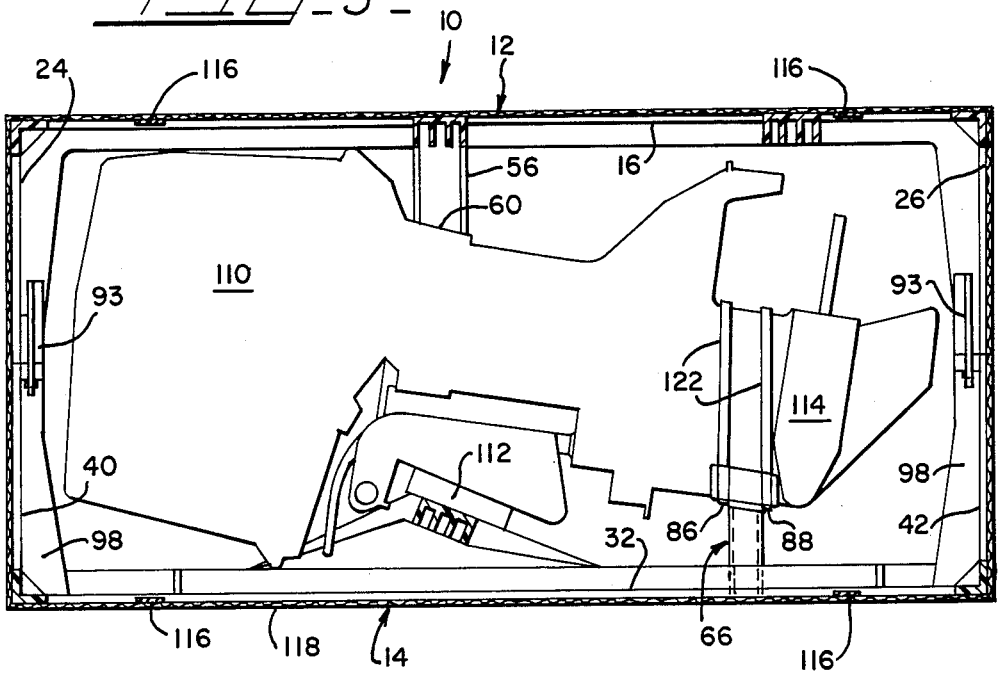
FIG. 3 is a median, vertical sectional view of the shipping frame with a contained outboard engine shown in phantom lines and the shipping frame slipped in an outer carton.
Figure 4:
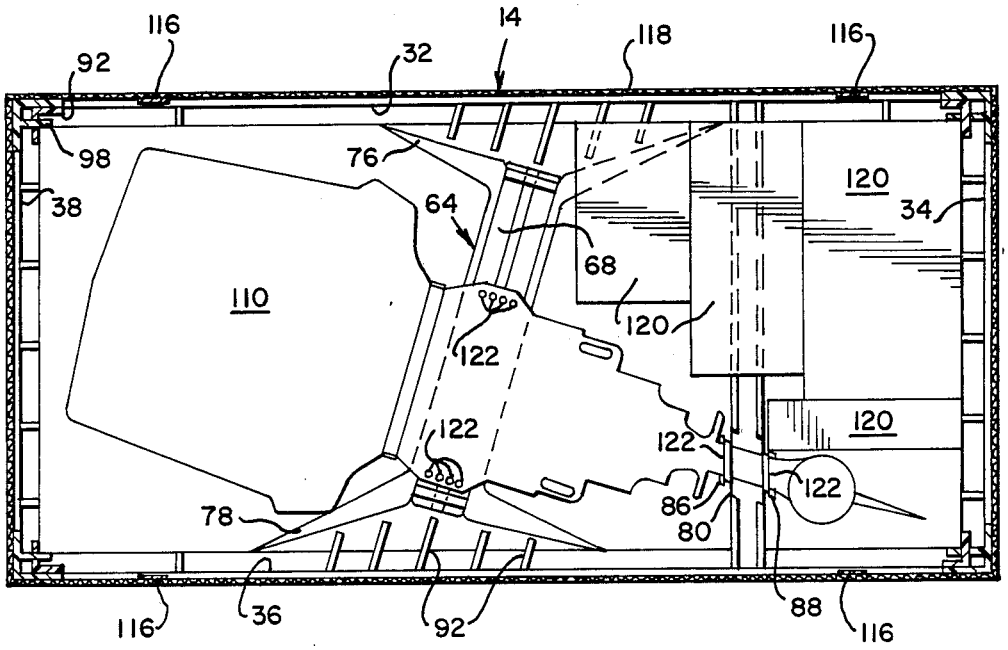
FIG. 4 is a median, horizontal sectional view of the shipping frame with a contained outboard engine and additional shipping cartons shown in phantom lines and the shipping frame slipped in the outer carton.

Referring to FIGS. 3 and 4, an outboard engine 110 is mounted in the shipping frame at its stern mounting plate 112 and lower gear case 114. Fasteners 122 secure the engine stern mounting plate to the cross-brace mounting member 64 while straps 124 secure the lower gear case 114 to the lips 86, 88 of the cradle 80 of cross-brace mounting member 66. Cradle 80 can be elevated, as shown above, or can be at any height desired. The two skeletons 12 and 14 are joined together and secured by bands or straps 116 and the entire shipping frame 10 is slipped into an outer corrugated carton 118. The shipping frame can be used without the outer corrugated carton where a damage indicator of a torn or punctured carton is not needed or desired.

Additionally, in FIG. 4, four accessory cartons 120 containing such as a gasoline can, propeller, gasoline hose, etc. can be contained in the shipping frame and carton.

In the shown preferred embodiment, the shipping frame mounts the engine at a small slant or angle for two reasons: one shipping frame can accommodate multiple size engines, reducing the number of different shipping frames required to ship the different size engines, and provides ample space in the shipping crate to receive the cartons 120. Of course, other arrangements of the engine in the shipping frame are possible as desired.

Figure 5:
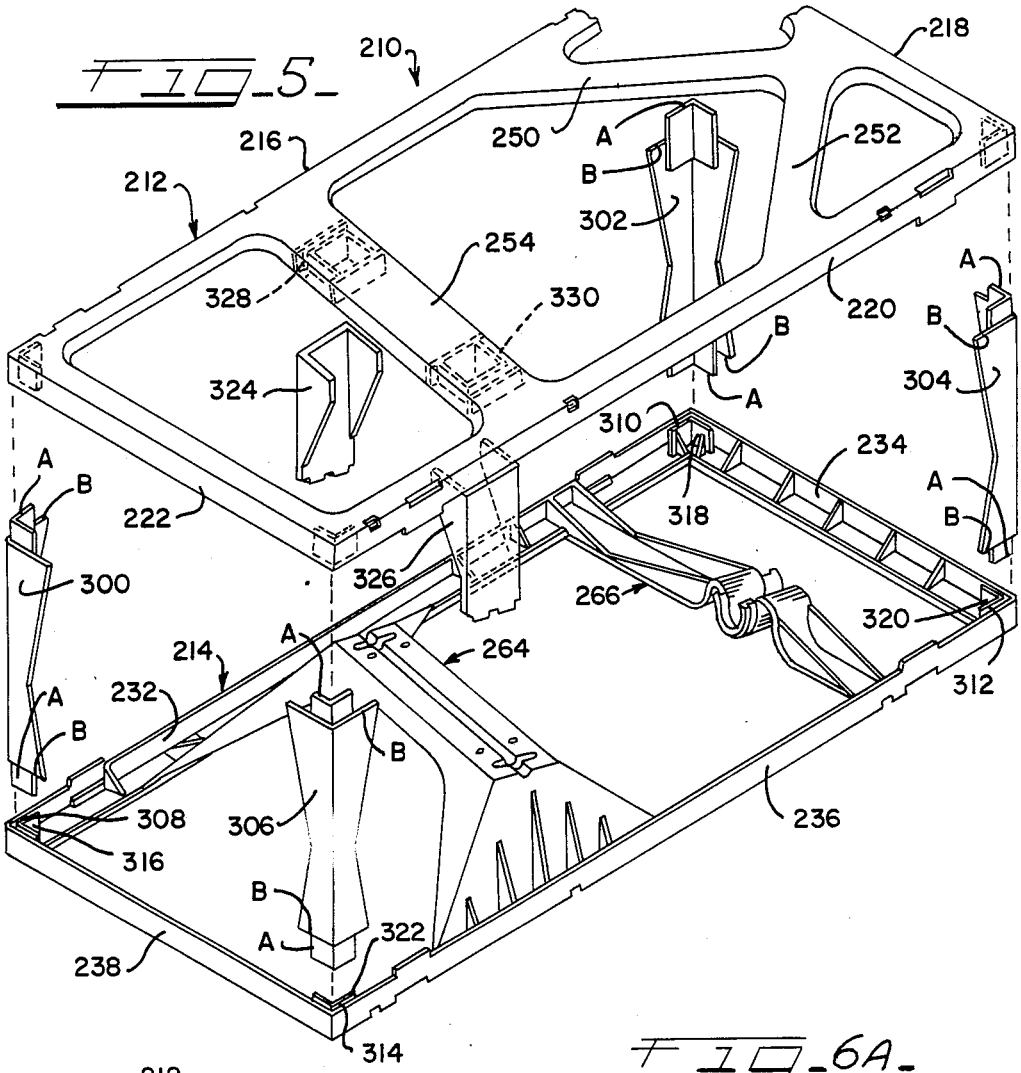
FIG. 5 is an exploded perspective view of another embodiment of the shipping frame having upper and lower skeletons and separate leg members and snubbers.
Figure 6A:
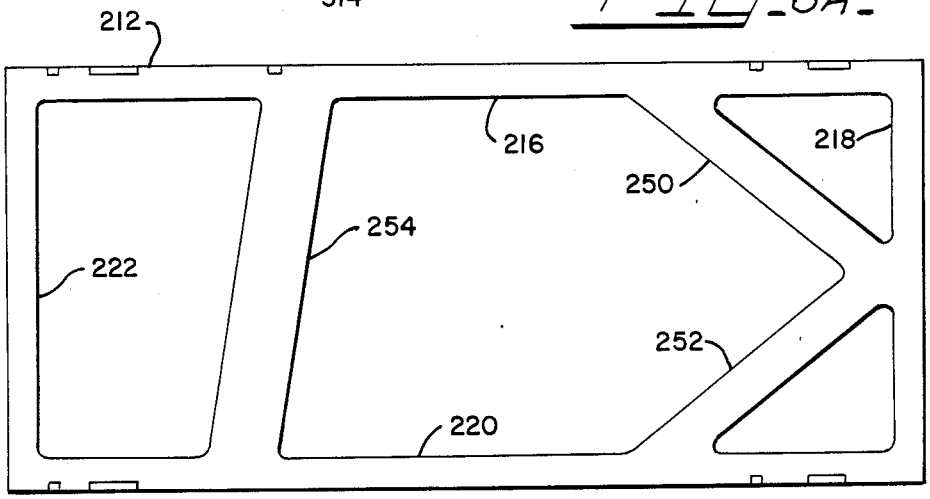
FIGS. 6A and 6B are respectively a plan view of the upper and lower skeletons in which the separate leg members and snubbers are integrally molded with the lower skeleton half by means of runners.
Figure 7:
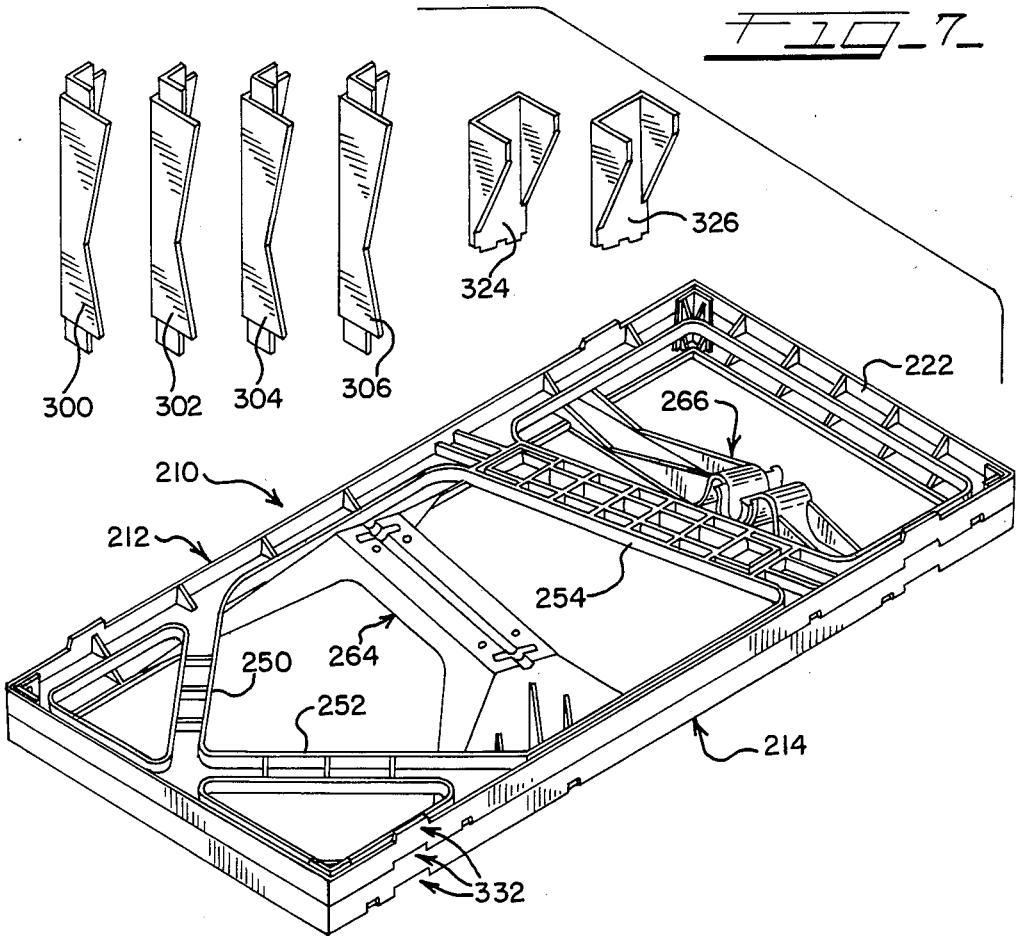
FIG. 7 is a perspective view of the upper and lower skeletons nested together for shipment, with the separate leg members and snubbers cut from the lower skeleton to simplify the illustration.

In FIGS. 5, 6 and 7 a second embodiment of the invention provides leg members and snubbers separate from the upper and lower skeletons. This facilitates nesting of the skeletons for flat shipment to the engine manufacturer and substantially reduces the cost of transporting the shipping frame to the user. Further, this arrangement ensures supplying the exact number of legs and snubbers required for assembly of the shipping frame to the goods. Except for the separate leg and snubber members, rhe structure is similar to that of FIGS. 1–4 and reference characters in the 200's will be used to identify like structure.

In FIG. 5, the second embodiment of a shipping frame construction and arranged according to the invention is indicated generally by the reference character 210. Shipping frame 210 is a box-like exterior frame or skeleton structure comprising upper and lower skeletons 212 and 214.

Upper skeleton 212 has four elongate, peripheral top members 216, 218, 220 and 222 joined together to form a flat rectangular structure. Lower skeleton likewise has four elongate, peripheral base members 232, 234, 236 and 238 also joined together at their ends in a flat rectangular arrangement.

The bottom surfaces of each of the base members again define a base plane that usually will rest on a warehouse floor for storage or on the bed of a truck for shipment. When the packages are stacked on one another, the base plane will rest on the top surface of an underlying package.

Upper skeleton 212 includes cross brace members 250 and 252 extending between peripheral top members 216, 218 and 220 to rigidfy the shipping frame and provide strength against torsional stress. Additional cross brace member 254 extends between peripheral top members 216 and 220 to carry two snubbers to be described presently.

Lower skeleton 214 includes cross brace mounting members 264 and 266 extending between the peripheral members 232 and 236. Cross brace members 264 and 266 include all of the structure described in connection with the like cross brace members of the first embodiment and provide all of the features and achievements thereof. Those features and achievements, therefore, will not be repeated here.

Shipping frame 210 further includes four leg members 300, 302, 304 and 306 that are elongate angled parts separate from the upper and lower skeletons 212 and 214. In the assembled condition of the shipping frame, leg members 300, 302. 304 and 306 extend between the upper and lower skeletons at the corners thereof. Lower skeleton 214 has slots 308, 310, 312 and 314 at the corner joints thereof, formed between tne outer walls of the peripheral base members and upstanding wall portions 316, 318, 320 and 322 integral with the peripheral members. Like slots are formed in the corners of the upper skeleton 212 with like depending wall parts. The opposed ends of the leg members each have extension tabs A constructed and arranged to be received in said slots with slip fits, in the upper and lower skeletons so that the walls of the leg members abutt with the upstanding walls of the peripheral members. The margins B of the leg members that are to abutt the upstanding walls of the peripheral members have some width associated therewith so as to provide lateral stability to the packaging arrangement after it is banded together.

The shipping frame 210 also includes two snubbers 324 and 326 that are received in slot arrangements 328 and 330 on the underside of cross brace member 254. Snubbers 324 and 326 when assembled into cross brace member 254 function the same as snubbers 54 and 56 in shipping frame 10 in all respects and will not be further discussed here.

Figure 6B:
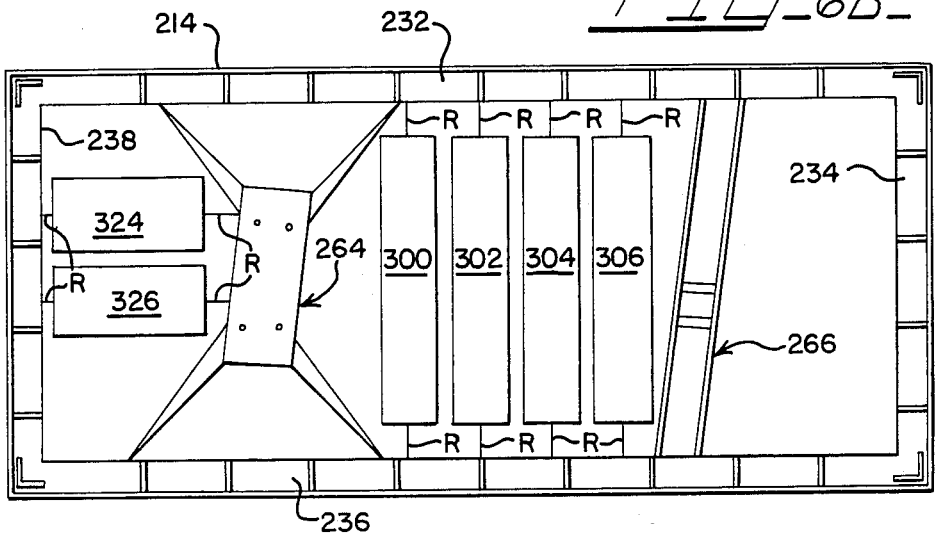

In FIG. 6*b*, leg members 300, 302, 304 and 306 and snubbers 324 and 326 are integrally molded with skeleton 214 by means of runners R. Runners R are thin sections of the structural foam material extending from the leg and snubber members to the base members that are formed during molding of the lower skeleton 214. Runners R are strong enough to retain the leg members and snubbers on the lower skeleton during transportation of the shipping frame to the end user and can readily be cut to remove the leg members and snubbers for assembly of the shipping frame with the manufactured goods. This insures that exactly the correct number of leg member and snubbers are transported with each shipping frame to assemble the shipping frame with the manufactured goods, alleviating costly shut doWns of the packaging line for want of a single jacking detail and avoiding the costly purchase of excess packing detail inventory.

In FIG. 7, the upper and lower skeletons 212 and 214 nest with one another to form a substantially flat assembly that reduces the shipping costs of the shipping frame to the user such as an engine manufacturer. The upper skeleton 212 is turned upsidedown and is rotated 180° in its plane to nest with lower skeleton 214. Raised cross brace mounting member 264 fits through the open space between cross brace members 250 and 252, and 254. Cross brace member 266 fits through the open space between cross brace member 254 and peripheral top member 222. Tab and slot arrangements 332, four places, provided along the peripheral members of the top and bottom skeletons serve to retain the nested skeletons in registration with one another. Although shown broken away from the nested skeletons, the legs and snubbers 300–306 and 324–326 are molded to accommodate this nesting of the upper and lower skeltons. The shipping frame 210 thus can be shipped in a "broken down" condition that adhieves a substantial cost savings in transporting the shipping frame to the packaging user.

In FIGS. 8–12, a third embodiment of the invention provides a shipping frame of overall robust construction to package finished internal combustion engines that are used for such as marine inboard power plants. The structure thereof substantially is similar to the structure illustrated in the first and second embodiments and reference characters in the four hundred series will be used to indicate like structure.

Figure 8:
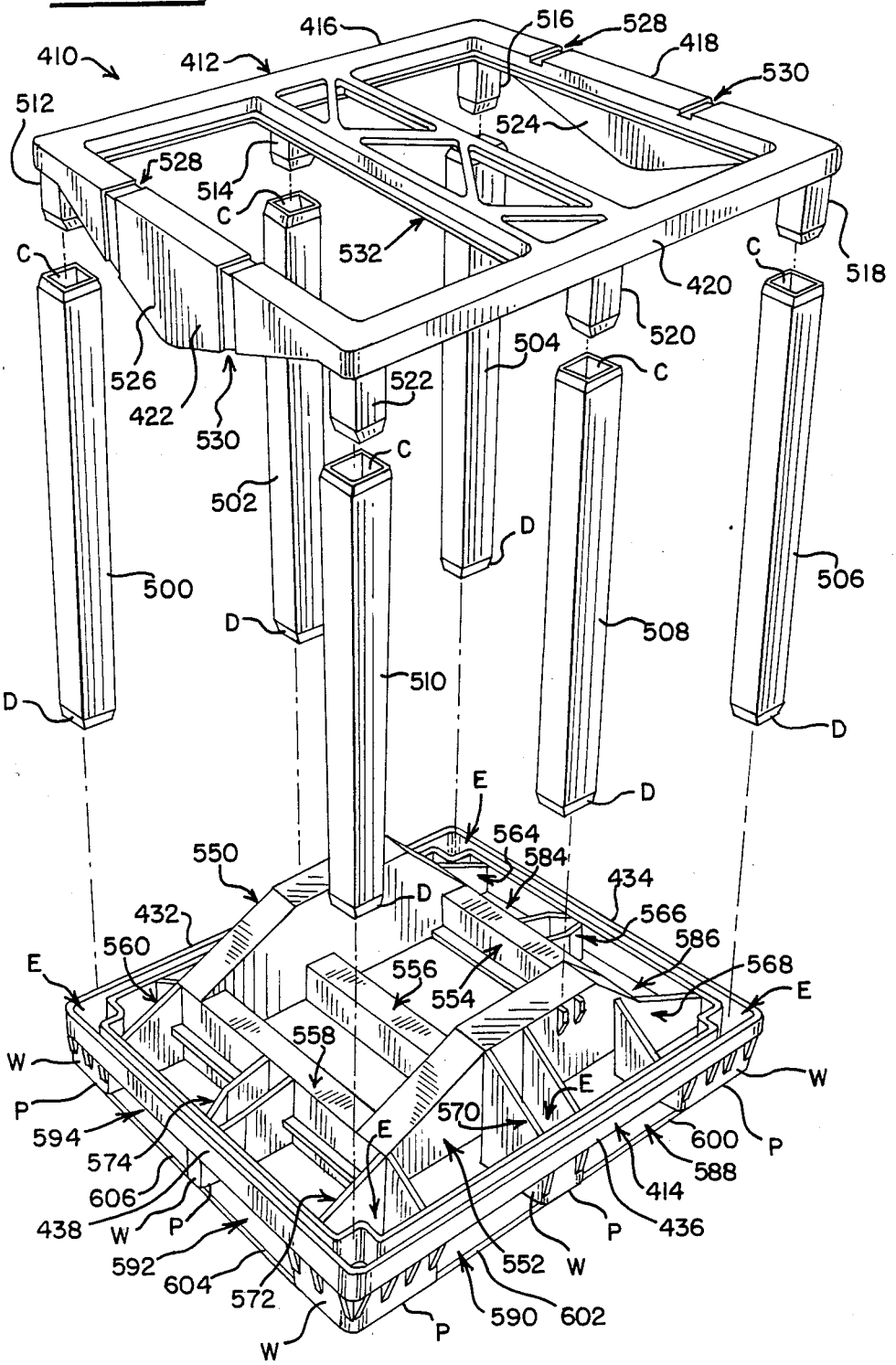
FIG. 8 is an exploded perspective view of a modified version of the embodiment having separate leg members.

In FIG. 8, third embodiment shipping frame 410 comprises an upper skeleton 412 and a lower skeleton 414. Upper skeleton 412 includes top peripheral members 416, 418, 420 and 422 joined together at their ends in a flat rectangular structure. Lower skeleton likewise has four elongate peripheral base members 432, 434, 436 and 438 joined together at their ends in a flat rectangular structure.

Shipping frame 410 further includes six elongate leg members 500, 502, 504, 506, 508 and 510 constructed and arranged to engage with the upper and lower skeletors 412 and 414 to space the same apart above and below a packaged engine and to support the top skeleton that can carry multiple shipping frames thereabove in a warehouse stack.

Top skeleton 412 also includes studs 512–522 depending from the top peripheral members 416 and 420, at the ends and median thereof, that fit into openings C at the top end of each of the legs 500–510 tightly to engage therewith and provide lateral stability to the shipping frame. Alternatively, the legs can present the studs, and the top skeleton can present the openings. The peripheral top members 418 and 422 include depending skirts 524 and 526 that strengthen the weight-carrying capacity of those top members when bands are applied around the shipping frame at such as slots 528 and 530 thereof.

Top skeleton 412 further includes a cross brace member 532 extending between peripheral top members 416 and 420 to rigidify the structure.

Figure 9:
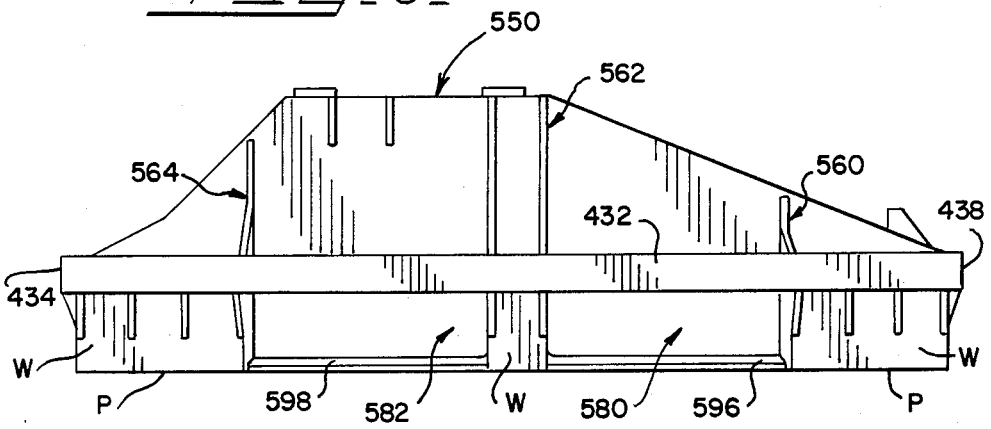
FIG. 9 is a side elevational veiw of the base skeleton of FIG. 8.
Figure 10:
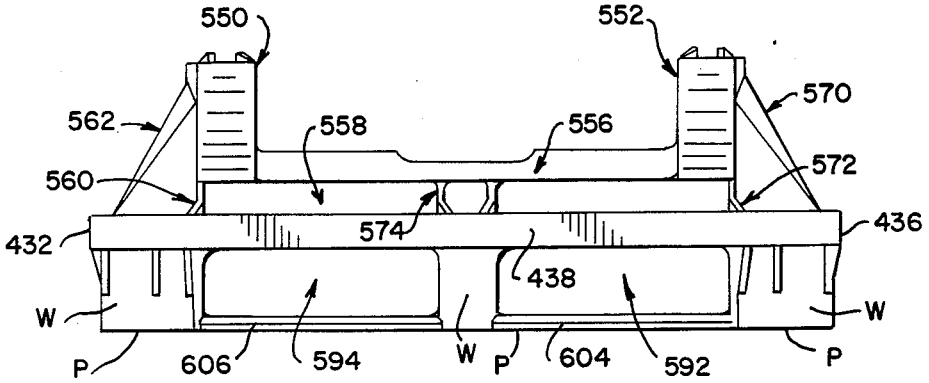
FIG. 10 is a front elevational view of the base skeleton of FIGS. 8 and 9.
Figure 11:
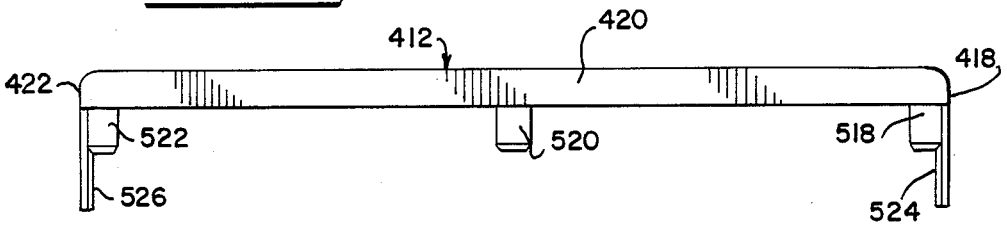
FIG. 11 is a side elevational view of the top skeleton of FIG. 8.
Figure 12:
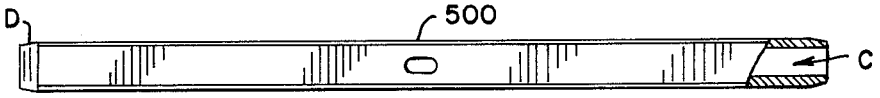
FIG. 12 is a side elevational view of a typical leg member of the modified version of FIG. 8.

Also referring to FIGS. 9 and 10, base skeleton 414 also includes a pair of spaced apart, raised cross brace members 550 and 552 extending between and supported by base members 434 and 438. Three cross brace members 554, 556 and 558 extend between the cross brace members 550 and 552 and the base peripheral members 432 and 436.

Eight double wall supporting portions 560–574 space the cross brace members from the base members and support the cross brace members above the floor or truck bed upon which the packaging shipping frame rests or is carried. These supporting portions 560-574 perform substantially the same shock and other force-absorbing functions as the support portions 76 and 78 of the embodiment shown in FIGS. 1–4, and 5–7. The base of each of the supporting structures 560–574 provide feet or pads P intended to rest upon the warehouse floor or the bed of a truck upon which the shipping frame packaged assembly is to rest for storage or shipping. In a stack, these pads will rest upon tne top surface of the lower shipping frame package.

The depending walls W of the supporting structures also space the base members 432, 434. 436 and 438 above the bottom surface of the pads P. This results in a structure providing four-way lift truck entry by way of openings 580–594. Base plates 596–606 provide rigidity for the base skeleton between the depending walls W and pads P of the supporting structures.

The bottom portions D of the legs 500–510 fit into pockets E at the corners of the base skeleton 414 and along the base members 432 and 436. The fit between the bottom portions D of the legs and the pockets E is tight to provide further lateral stability to the shipping frame of the invention.

The shipping frame of the invention can be modified an desired to conform to other large, heavy assemblies or goods to be shipped or stored. The skeleton halves greatly simplify the packing and unpacking of goods such as a marine engine while reducing the cost and weight of the packing materials. While individual ones or the shipping frames can easily be disposed of by existing scavenger services, plural shipping frames can be re-used for repetitive shipments of finished goods or assemblies such as gasoline engines to a lawn mower manufacturer.

Other modifications of the shipping frame disclosed are possible while remaining within the scope of the invention. For example, the periheral members can be triangular, square or rectangular in cross-section instead of the right angle shape with ribs shown. The shipping frame can outline any polygonal shape desired other than a rectangular solid. The assembly or goods to be shipped can be entirely nested in cradles or between snubbers instead of being positively secured with bolts and bands. Additional or fewer cross-brace members and mounting members can be used. Different interlock structures can be used at the ends of the leg members. Different nesting of legs, snubbers and skeleton halves can be used.

While the invention has been described with reference to a preferred embodiment, it will be understood by those skilled in the art that various changes may be made and equivalants may be substituted for elements thereof without departing from the broader aspects of the invention. Also, it is intended that broad claims not specifying details of a particular embodiment disclosed herein as the best mode contemplated for carrying out the invention should not be limited to such details. Furthermore, while, generally, specific claimed details of the invention constitute important specific aspects of the invention in appropriate instances even the specific claims involved should be construed in light of the doctrine of equivalents.

I claim:

1. A shipping frame for packaging a manufactured article and the like in storage and transport, said shipping frame comprising:

a pair of skeleton halves for joining together into a unitary structure and being adapted to confine the article during shipping and storage, each skeleton half including plural peripheral members joined at their ends and arranged to define the intersections of the sides of the frame; and at least one of the skeleton halves including at least one cross-brace mounting member extending between the peripheral members thereof, said at least one cross-brace mounting member being supported by said at least one skeleton half to be spaced inwardly of said frame and adapted to carry said article secured thereto and spaced inwardly of said frame, the skeleton halves each being integrally molded of structural foam material and the sides thereof being free of interconnecting material except at said members.

2. The shipping frame of claim 1 in which said skeleton halves are integrally molded of high density polyethylene structural foam thermoplastic material.

3. The shipping frame of claim 1 in which said members have cross-section shapes of right angles with strengthening ribs therein.

4. The shipping frame of claim 1 in which each skeleton half has four elongate peripheral members joined at their ends in the shape of a rectangle and there are four leg members extending from the corners thereof.

5. The shipping frame of claim 4 in which the legs members are substantially the same length.

6. The shipping frame of claim 1 in which some of the peripheral members form legs and the legs of the skeleton halves have mating interlock means to maintain the legs in registration when the skeleton halves are joined together.

7. The shipping frame of claim 6 in which said mating interlock means include one extending panel, having a notch, on each leg of the skeleton halves arranged and constructed so that the notches on corresponding legs can mate with one another.

8. The shipping frame of claim 6 in which said mating interlock means provide a notched structure on each leg member that engages corresponding notch structure of a corresponding leg at a level other than at the level of engagement of the ends of the legs.

9. The shipping frame of claim 1 in which said at least one cross-brace mounting member includes a connecting portion and opposed support portions extending from said connecting portion to said peripheral members.

10. The shipping frame of claim 1 in which said cross brace mounting member includes a mounting portion spaced inwardly from a side of the frame and support portions extending from said mounting portion to respective peripheral members for maintaining said mounting portion in said spaced position and distributing the weight of said manufactured article adapted to be carried on said mounting portion to said peripheral members.

11. The shipping frame of claim 10 in which said support portions are angled inwardly from the sides of said frame to place the material thereof in tension and torsion for absorbing forces applied to said frame in storing and transporting said manufacture article.

12. The shipping frame of claim 11 in which the other skeleton half includes snubber extensions from said cross-brace members adapted to engage and support said article.

13. The shipping frame of claim 1 in which the peripheral members of said skeleton halves include grooves adapted to receive bands for maintaining said skeleton halves joined together in a unitary structure.

14. A shipping frame for packaging a manufactured article and the like in storage and transport, said shipping frame comprising:

upper and lower skeleton halves that can be joined together into a unitary structure outlining a multi-sided solid structure, said skeleton halves cooperating to confine said article during shipping and storage, the skeleton halves each including plural peripheral members joined at their ends and there being plural peripheral leg members extending therefrom, the leg members being substantially of equal length, the peripheral and leg members defining the margins of the sides of the frame, the skeleton halves further including cross-brace members extending between the peripheral members, at least one of the skeleton halves including a cross-brace mounting member extending between the peripheral members thereof, said cross-brace mounting member being supported by said peripheral members to be spaced inwardly of said frame and adapted to carry said assembly secured thereto and spaced inwardly of said frame, the skeleton halves being integrally molded of high density plastic structural foam material and the sides thereof being open and free of material except at said members.

15. The shipping frame of claim 14 in which said high density plastic structural foam material is polyethylene.

16. The shipping frame of claim 14 including interlock means at the end of each leg member to maintain engaged the ends of the leg members when the skeleton halves are joined together.

17. The shipping frame of claim 14 in which each said skeleton half includes leg members integrally molded therewith.

18. The shipping frame of claim 14 in which said leg members are separate from said skeleton halves and are assembled therewith.

19. The shipping frame of claim 14 in which said cross brace mounting member includes a mounting portion spaced inwardly from a side of the frame and support portions extending from said mounting portion to respective peripheral members for maintaining said mounting portion in said spaced position and distributing the weight of said manufactured article adapted to be carried on said mounting portion to said peripheral members.

20. The shipping frame of claim 14 in which said support portions are angled inwardly from the sides of said frame to place the material thereof in tension and torsion for absorbing forces aplied to said frame in storing and transporting said manufactured article.

21. A shipping frame for packaging a manufactured article and the like in storage and transport, said shipping frame comprising:

upper and lower skeleton halves and plural elongate leg members that can be joined together into a unitary structure outlining a multi-sided solid structure, said skeleton halves adapted to confine said article therein, the skeleton halves each including plural peripheral members joined at their ends and said peripheral leg members being assembled to said skeleton havles to extend between said peripheral members, the length of said leg members determining the distance between said skeleton halves, the peripheral and leg members defining the margins of the sides of the frame, the skeleton halves further including cross-brace members extending between the peripheral members, at least one of the skeleton halves including a cross-brace mounting member extending between the peripheral members thereof, said cross-brace mounting member being supported by said peripheral members to be spaced inwardly of said frame and adapted to carry said assembly secured thereto and spaced inwardly of said frame, the skeleton halves being integrally molded of high density plastic structural foam material and the sides thereof being open and free of material except at said members.

22. The shipping frame of claim 21 in which said high density plastic structural foam material is polyethylene.

23. The shipping frame of claim 21 including snubbers that slip into slots in at least one of said skeleton halves.

24. The shipping frame of claim 21 in which said skeleton halves include slots into which said leg member can slip.

25. The shipping frame of claim 21 in which at least said leg members are molded integrally with one of said skeleton halves to extend between peripheral members thereof by runners that can be cut to sever the leg members from the peripheral members.

26. The shipping frame of claim 25 in which snubbers also are integrally molded with one of said skeleton halves to extend between peripheral members thereof by runners that can be cut to sever the snubbers from the peripheral members.

27. The shipping frame of claim 21 in which said cross brace mounting member includes a mounting portion spaced inwardly from a side of the frame and support portions extending from said mounting portion to respective peripheral members for maintaining said mounting portion in said spaced position and distributing the weight of said manufactured article adapted to be carried on said mounting poriton to said peripheral members.

28. The shipping frame of claim 27 in which said support portions are angled inwardly from the sides of said frame to place the material thereof in tension and torsion for absorbing forces applied to said frame in storing and transporting said manufactured article.

29. A shipping frame for packaging a manufactured article in storage and transport, said shipping frame comprising:

A. a base skeleton formed of integrally molded peripheral base members arranged to define the outer margins of substantially the bottom side of said shipping frame;

B. at least one cross-brace member integrally molded with said peripheral base members to extend therebetween, said at least one cross-brace member being supported by said base members to be spaced inwardly of said frame from said bottom side, said cross-brace member being adapted to carry said article spaced from said bottom side and distributing the weight of said article to said peripheral base members;

C. a top skeleton formed of integrally molded peripheral top members arranged to define the outer margins of the top side of said shipping frame; and D. leg members extending between the base skeleton and top skeleton to space apart the base and top skeleton and to define the margin of the lateral sides of said shipping frame.

30. The shipping frame of claim 29 in which said sides of said shipping frame are free of molded material except at said members.

31. The shipping frame of claim 29 in which said skeletons are molded of structural foam material.

32. The shipping frame of claim 30 in which said structural foam material is high density polyethylene.

33. The shipping frame of claim 29 in which said cross brace mounting member includes a mounting portion adapted to carry said article and that is spaced inwardly from the bottom side of the frame, said cross brace mounting member further including support portions extending from said mounting poriton to respective peripheral base members for maintaining said mounting portion in said spaced position and distributing the weight of said manufactured article to said peripheral members.

34. The shipping frame of claim 33 in which said support portions are angled inwardly from the sides of said frame to place the material thereof in tension and torsion for absorbing forces applied to said frame in storing and transporting said manufactured article.

35. The shipping frame of claim 34 in which said support portions extend below the peripheral base members to terminate in feet adapted to rest upon a support surface and forming openings therebetween, said openings being adapted to receive the tines of a fork lift truck.

36. The shipping frame of claim 35 in which the base skeleton includes plates of molded material extending between the feet to rest on said support surface and define a lower margin of said openings.

37. The shipping frame of claim 29 in which each of said leg members include a lower and upper portion, all of the lower portions of the leg members being integrally molded with the base skeleton and all of the upper portions of the leg members being integrally molded with the top skeleton.

38. The shipping frame of claim 29 in which said leg members are separate from said base and top skeletons and are assembled thereto.

39. The shipping frame of claim 38 in which said base skeleton includes upward facing cups receiving the bottom ends of said leg members to provide lateral support to said shipping frame.

40. The shipping frame of claim 38 in which said top skeleton includes depending studs engaging with the top ends of said leg members to provide lateral support to said shipping frame.

41. The shipping frame of claim 1 in which there are leg members separate from said skeleton halves and joined to extend between said skeleton halves in said unitary structure.

42. The shipping frame of claim 21 in which said lower skeleton includes upward facing cups for receiving the bottom ends of said leg members to provide lateral support to said shipping frame.

43. The shipping frame of claim 21 in which said upper skeleton includes depending studs for engaging with the top ends of said leg members to provide lateral support to said shipping frame.

* * * * *